United States Patent [19]

Auer et al.

[11] Patent Number: 4,889,515

[45] Date of Patent: Dec. 26, 1989

[54] FOUR-WHEEL DRIVE TOY AND TRUCK ASSEMBLY

[75] Inventors: Robert T. Auer, East Stroudsburg, Pa.; David Reina, Maplewood, N.J.

[73] Assignee: Buddy L Corporation, New York, N.Y.

[21] Appl. No.: 114,283

[22] Filed: Oct. 29, 1987

[51] Int. Cl.[4] ..... A63H 17/05

[52] U.S. Cl. ..... 446/428; 446/424; 446/465; 446/470; 419/477

[58] Field of Search ..... 446/237, 424, 425, 426, 446/427, 428, 431, 441, 443, 447, 448, 449, 457, 462, 465, 470, 471; 180/14.7, 198; 414/477, 478, 479, 480

[56] References Cited

U.S. PATENT DOCUMENTS

| | | | |
|---|---|---|---|
| 3,001,825 | 9/1961 | Rouse | 414/477 X |
| 3,032,217 | 5/1962 | Musson et al. | 414/477 X |
| 3,074,574 | 1/1963 | Prince | 414/477 |
| 4,047,630 | 9/1977 | Young | 414/480 X |
| 4,318,657 | 3/1982 | Znidariz | 414/478 |
| 4,415,055 | 11/1983 | Ahn | 180/9.1 X |
| 4,565,538 | 1/1986 | Kennedy et al. | 446/443 X |
| 4,573,943 | 3/1986 | Kennedy et al. | 446/443 X |
| 4,698,044 | 10/1987 | Kennedy et al. | 446/462 X |
| 4,708,683 | 11/1987 | Lehmann et al. | 446/428 X |
| 4,717,367 | 1/1988 | Stubenfoll et al. | 446/441 X |

OTHER PUBLICATIONS

TEDCO, "Piggyback Transporter", 1961.

*Primary Examiner*—Robert A. Hafer
*Assistant Examiner*—Sam Rimell
*Attorney, Agent, or Firm*—Michael Ebert

[57] ABSTRACT

A piggyback toy car and truck assembly in which all four wheels of the car are driven by a battery-powered motor, the truck being of the flat bed type and motorless. The car is switchable from a neutral mode to operation in either the forward or reverse mode, its front and rear wheel axles each having a drive pinion mounted thereon whose teeth are projected below the chassis. Lying on the flat bed of the truck is a ramp having a pair of tracks for accommodating the car wheels. The ramp is slidable from a retracted horizontal position to an extended horizontal position in which the rear half section of the ramp overhangs the rear of the bed and is pivoted therefrom so that it is then free to swing down to form an inclined ramp. With the ramp so inclined, the car in its forward mode climbs up the ramp until it reaches its front end and causes the inclined ramp to return to its horizontal extended position. At this position, the front pinion on the car meshes with a ramp gear operatively coupled to a ramp pinion that engages a rack running along the bed to cause the ramp to advance to its retracted position. At this position, the rear drive pinion of the car meshes with a bed gear operatively coupled to the rear wheels of the truck whereby the motorized car then acts to drive the motorless truck in the forward direction.

11 Claims, 8 Drawing Sheets

FOUR-WHEEL DRIVE TOY AND TRUCK ASSEMBLY

BACKGROUND OF INVENTION

1. Field of Invention

This invention relates generally to toy vehicles, and in particular to a piggyback toy car and truck assembly in which the car is motorized but the truck is motorless, the car acting when positioned on the truck to drive the truck.

2. Status of Prior Art

The term "piggyback" in the field of transportation refers to the loading, transporting and unloading of truck trailers on railroad flat bed cars. Thus if goods are to be shipped by railroad to a destination, instead of bringing the goods by trailer truck to the railroad loading dock and then taking the goods out of the trailer and putting them into a railroad box car, the loaded trailer is hoisted onto the bed of a flat bed car.

Piggyback arrangements in which a motorized vehicle acts to drive a motorless vehicle are known in the prior art. Thus the 1908 patent to Knut U.S. Ser. No. 881,008 shows in one embodiment an automobile which is seated on a railroad truck and is coupled to the axle of the truck wheels such that power from the automobile is transferred to the truck. In another embodiment, the power from an automobile is transferred to the propeller of a boat.

In the 1983 patent to Ahn, U.S. Pat. No. 4,415,055, a motorized truck is seated on a motorless tractor, power from the truck being transferred to the tractor. Also of background interest in regard to the transfer of power from a motorized device to a motorless device is and the 1975 patent to Joshi et al., U.S. Pat. No. 3,883,987.

SUMMARY OF INVENTION

The main object of this invention is to provide a piggyback toy car and truck assembly in which the car is motorized whereas the truck is motorless, the car acting when positioned in the back of the truck to drive the truck. While the invention will be described in connection with a car and truck assembly, it is to be understood that it is applicable to an assembly in which the larger vehicle which is motorless need not be in the format of a truck, or the smaller motorized vehicle need not be in the format of a car or auto.

More particularly, an object of this invention is to provide an assembly of the above type in which the motorless truck is of the flat bed type having a ramp slidable along the bed and pivoted therefrom so that the ramp may be extended from the rear of the bed and swung down to form an inclined ramp, making it possible for the motorized car operating in the forward mode to climb up the ramp and assume a position on top of the truck bed, the motorized car in the reverse mode climbing down the ramp to separate itself from the nonmotorized truck.

A significant feature of the invention is that the motorized car is battery powered and switchable from a neutral, free-wheeling mode to either a forward or reverse mode, the assembly of car and truck being capable of carrying out the following play activities:

A. By switching the car to operate in the forward mode, the car can then climb up the ramp onto the flat bed of the truck and drive the car forward.

B. By then switching the car on the back of the truck to neutral, the truck is brought to a halt.

C. By then switching the car to operate in the reverse mode, the car automatically backs off the ramp and the truck stops.

D. By switching the car t its neutral mode when it is separated from the truck, it may be played with like any freewheeling car.

Thus a child playing with the assembly can play separately with the truck or the car as he pleases, or he can play with them in combination to carry out a variety of activities. Hence the assembly, because of its versatility, continues to engage the child's interest for a far greater period than would be the case had the child been given a truck and toy car having no cooperative relationship.

Briefly stated, these objects are attained in a piggyback toy car and truck assembly in which all four wheels of the car are driven by a battery-powered motor, the truck being of the flat bed type and motorless. The car is switchable from a neutral mode to operation in either the forward or reverse mode, its front and rear wheel axles each having a drive pinion mounted thereon whose teeth are projected below the chassis. Lying on the flat bed of the truck is a ramp having a pair of tracks for accommodating the car wheels. The ramp is slidable from a retracted horizontal position to an extended horizontal position in which the rear half section of the ramp overhangs the rear of the bed and is pivoted therefrom so that it is then free to swing down to form an inclined ramp. With the ramp so inclined, the car in its forward mode climbs up the ramp until it reaches its front end and causes the inclined ramp to return to its horizontal extended position. At this position, the front pinion on the car meshes with a ramp gear operatively coupled to a ramp pinion that engages a rack running along the bed to cause the ramp to advance to its retracted position. At this position, the rear drive pinion of the car meshes with a bed gear operatively coupled to the rear wheels of the truck whereby the motorized car then acts to drive the motorless truck in the forward direction. When the car on the ramp is thereafter switched into the reverse mode, it then acts through its front drive pinion to shift the ramp to its extended position, the ramp then swinging down to permit the car to back off the ramp.

BRIEF DESCRIPTION OF DRAWINGS

For a better understanding of the invention as well as other objects and further features thereof, reference is made to the following detailed description to be read in conjunction with the accompanying drawings, wherein.

DESCRIPTION OF INVENTION

Structure of Assembly

Figure 1:
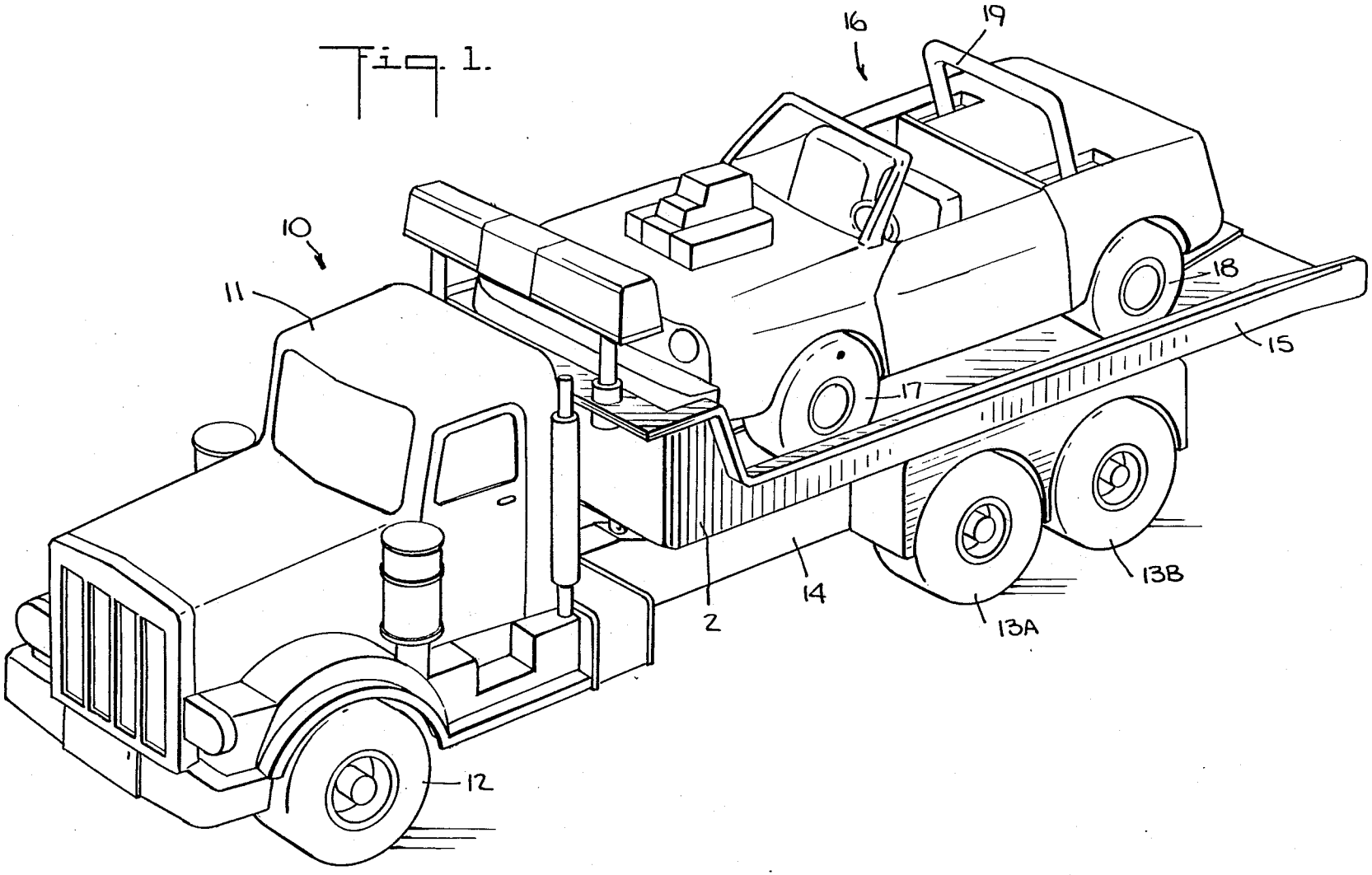
FIG. 1 is a perspective view of a battery-operated, motor driven toy car and motor-free truck assembly in accordance with the invention, the car being switched to operate in the forward mode in which it acts to propel the truck in the same direction.

Referring now to FIG. 1, there is illustrated a piggyback toy car and truck assembly in accordance with the invention. The assembly comprises a motorless truck, generally designated by numeral 10, having a driver's cab 11 adjacent a single set of front wheels 12, and a double set of rear wheels 13A and 13B. Behind cab 11 is a flat bed 14, and lying on this bed and slidable thereon is a ramp 15 on which is placeable a battery-powered motorized toy car, generally designated by numeral 16, having a set of front wheels 17 and a set of rear wheels 18. All four wheels of car 16 are driven in either a forward or reverse mode or are free-wheeling in a neutral mode.

Car 16 is provided with a mode selector actuated by a roll bar 19 which when tilted forward causes a polarity-reversing switch (not shown) to connect a battery power supply to a DC motor in a polarity producing motor rotation in a direction causing forward motion of the car. When roll bar 19 is in its upright position, the car then operates in the neutral mode and is free wheeling so that it can be manually pushed to run along a play surface. And when roll bar 19 is tilted back by the player, the polarity of the voltage applied to the motor is reversed and the car is then driven in the reverse direction.

Figure 6:
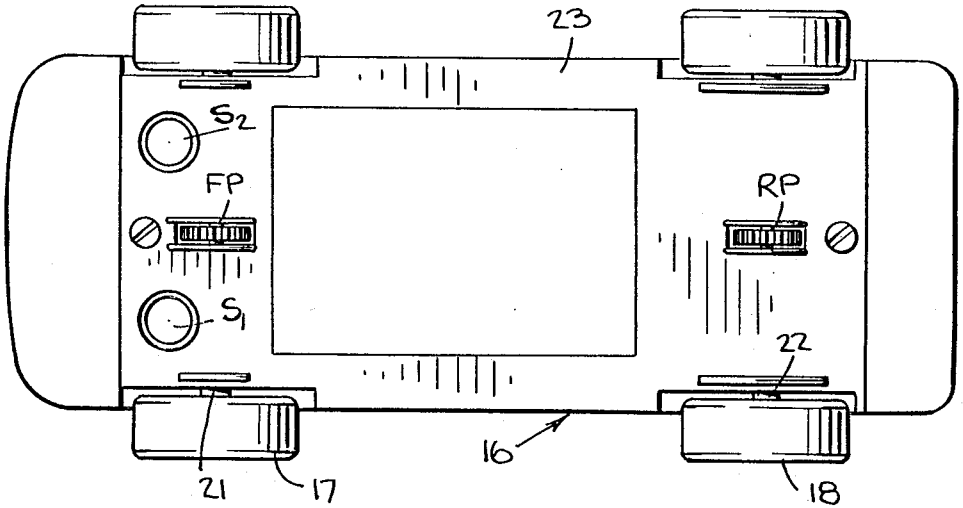
FIG. 6 is a bottom view of the car showing its front and rear drive pinions.
Figure 10:
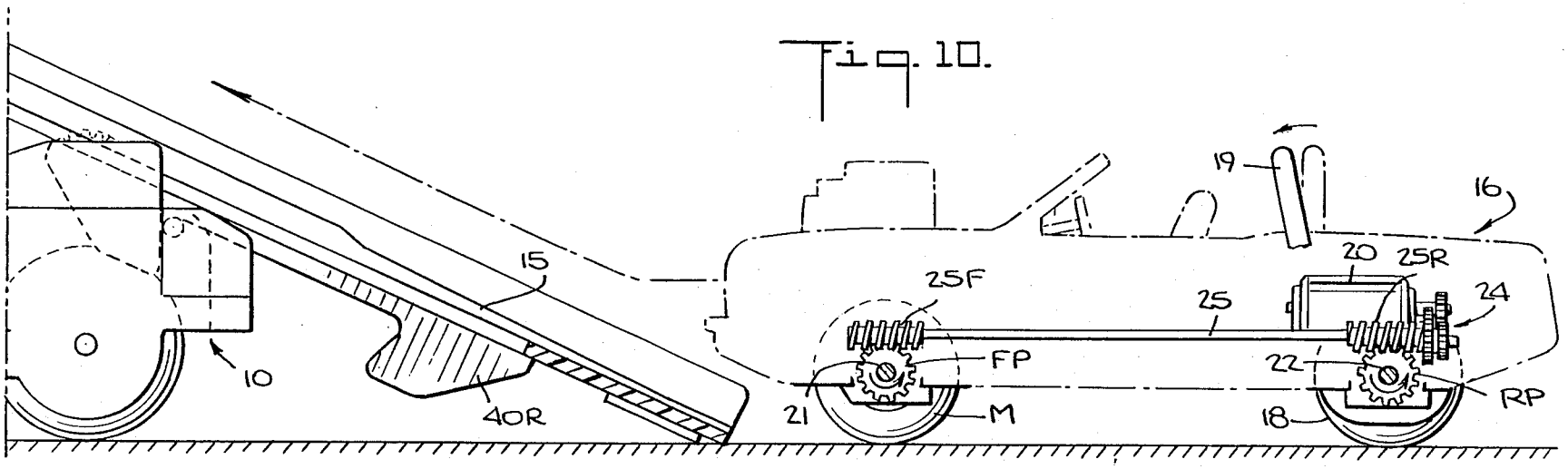
FIG. 10, partly in section, shows the ramp in its inclined position about to receive the oncoming car which is switched to move forward so as to climb up the ramp.

Car 16, as best seen in FIGS. 6 and 10, is provided with a DC motor 20 which is operatively coupled both to a front drive pinion FP mounted at the center of the front wheel shaft 21 of the car and to a rear drive pinion RP mounted at the center of rear wheel shaft 22. The teeth of these pinions project below the underside of chassis 23 of the car so that they are free to engage and drive respective input gears on the ramp and bed of the truck. Inset on chassis 23 of car 16 on either side of pinion FP are holding sockets $S_1$ and $S_2$ adapted to receive the heads of hold pins, to be later described, which are supported on ramp 15.

The linkage between motor 20 and drive pinions FP and RP is by way of a gear train 24 which couples motor 20 to a horizontal shaft 25 extending between the front and rear drive pinions FP and RP. Shaft 25 is provided with a worm gear section 25F at its front end which engages front drive pinion FP, and a worm gear section 25R at its rear end which engages rear drive pinion RP.

Hence when roll bar 19 is tilted forward from neutral to switch the car into its forward mode of operation, the motor then turns the front and rear wheels 17 and 18 counterclockwise to propel the car forward. The car is propelled in the reverse direction when roll bar 19 is tilted back from neutral. At neutral, the roll bar acts through its associated polarity-reversing electrical switch to cut off power to the motor, and through an associated mechanism (not shown) to decouple drive shaft 25 from the front and rear drive pinions FP and RP, so that the wheels are then free wheeling.

As best seen in FIGS. 1 to 5, ramp 15 is provided at its front end with an abutment 26 behind which is a pair of parallel tracks 30 and 31 with an open space therebetween, the tracks running the full length of the ramp to accommodate therein the wheels of the car. Adjacent abutment 26 is a plate 27 bridging tracks 30 and 31 and supporting a gear box 32 having rotatably mounted therein a ramp gear 33 whose teeth project above the upper face of the box so that they can be engaged by the front drive pinion FP of the car. Ramp gear 33 is operatively coupled to a ramp pinion 34 whose teeth project below the underface of the gear box to engage a rack on bed 14 of the truck in a manner to be later explained.

Positioned on either side of gear box 32 are two metal hold pins 35 and 36 having enlarged heads, the pins being supported for vertical reciprocation in bearings 37 and 38 on plate 27. The tips of pins 35 and 36 have plastic shoes 35A and 36A fitted thereon.

Attached to the underside of ramp 15 and projecting downwardly from the ramp are blades 39 and 40 which run parallel to the ramp tracks and ride in parallel channels 41 and 43 defined at the rear of the bed by the rear wheel housings which are spaced from the bed. Each blade, such as blade 40 shown in FIGS. 8 and 9, is contoured to form a front tooth 40F and a rear tooth 40R, the distance between these teeth determining the limits of sliding movement of the ramp.

Figure 8:
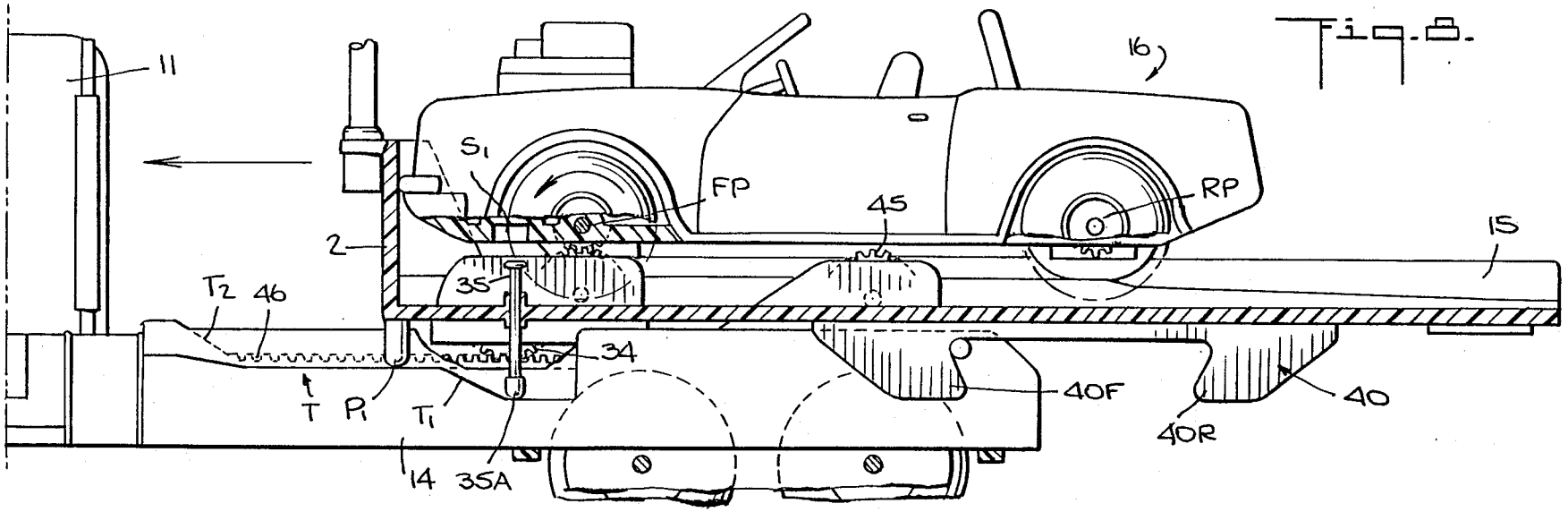
FIG. 8, partly in section, shows the car after it has climbed up the inclined ramp to cause it to return to its extended horizontal position on the bed of the truck, the car, which is switched to operate in the forward mode, then acting to drive the ramp to its retracted position adjacent the cab.
Figure 9:
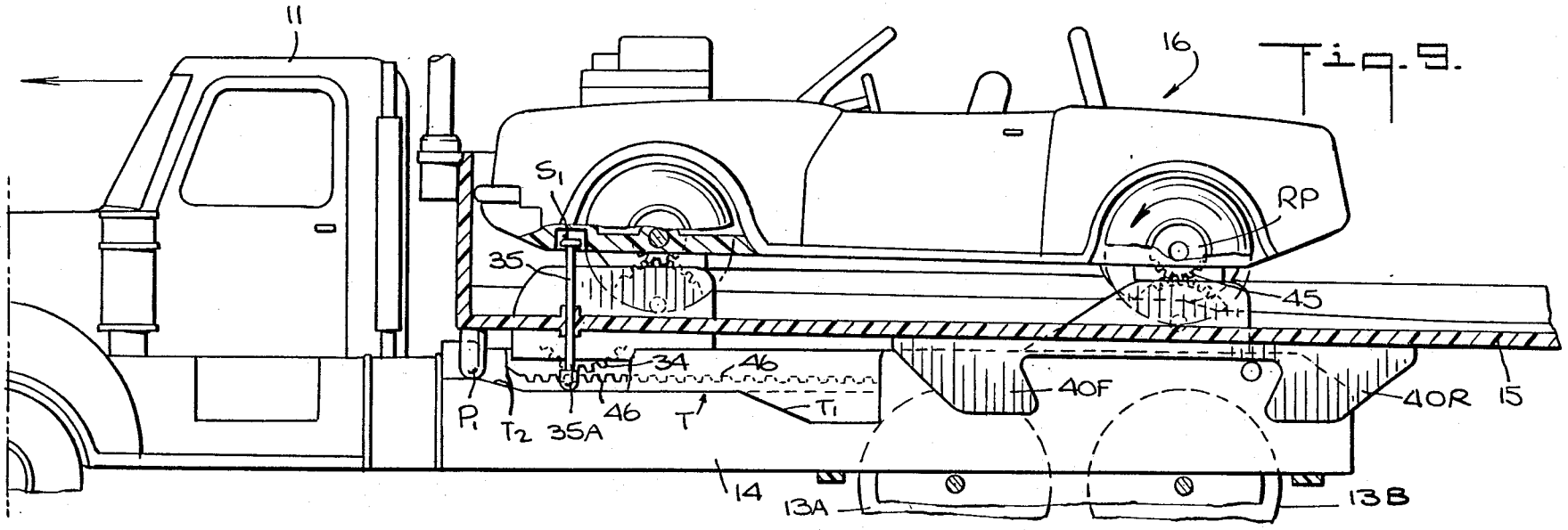
FIG. 9 shows the car on the ramp when the ramp occupies its retracted horizontal position at which the car is locked in place on the ramp.

Ramp 15 is slidable on bed 14 from an extended horizontal position, as shown in FIG. 8, in which front tooth 40F on the blade engages a pivot pin P at the rear section of the bed, to a retracted position, as shown in FIG. 9, in which rear tooth 40R then engages the pivot pin P.

In the extended horizontal position, the rear section of the ramp overhangs the rear of the bed, and the ramp is then free to swing on pivot pin P, whereas in the retracted position, the front abutment 26 of the ramp is adjacent cab 11 of the truck.

Figure 7:
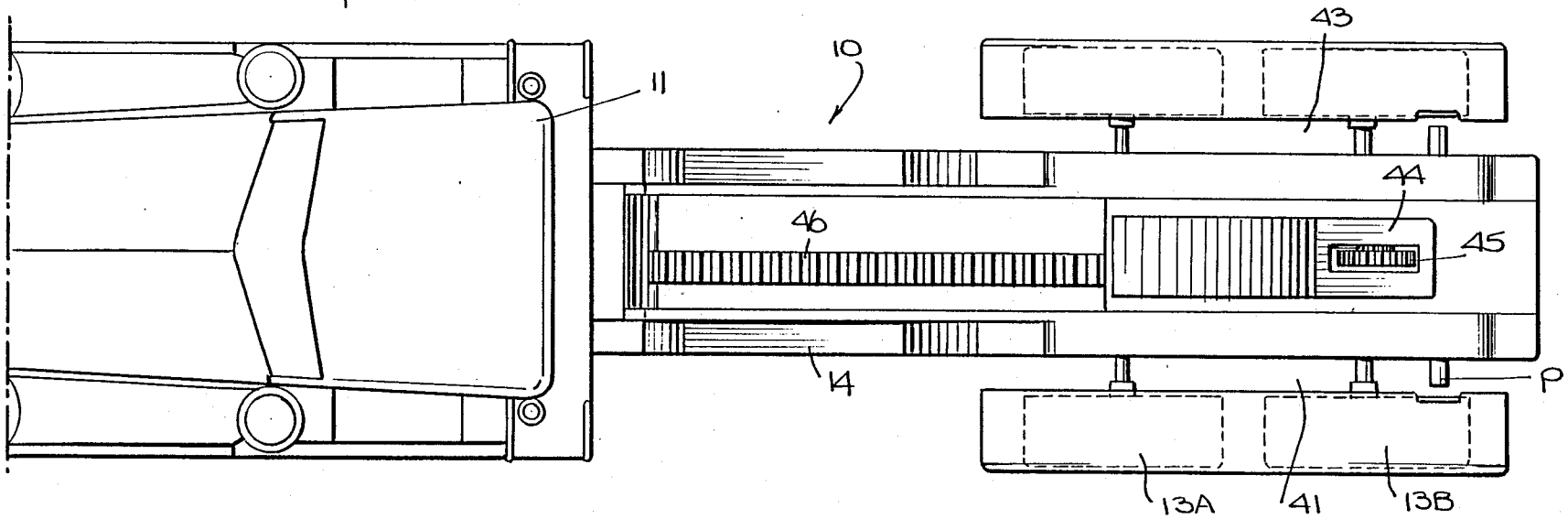
FIG. 7 illustrates the truck in a top view with the ramp removed to expose the bed of the truck.

As shown in FIG. 7, the flat bed 14 of truck 10 is provided at its rear between the rear set of wheels 13A and 13B with a gear box 44 which is centered with respect to the rear wheel housings. Mounted for rotation in gear box 44 is a bed gear 45 whose teeth project above the upper face of this box. Extending along the front section of bed 14 on a longitudinal axis between cab 11 of the truck and gear box 45 on the rear section is a straight rack 46.

Figure 11:
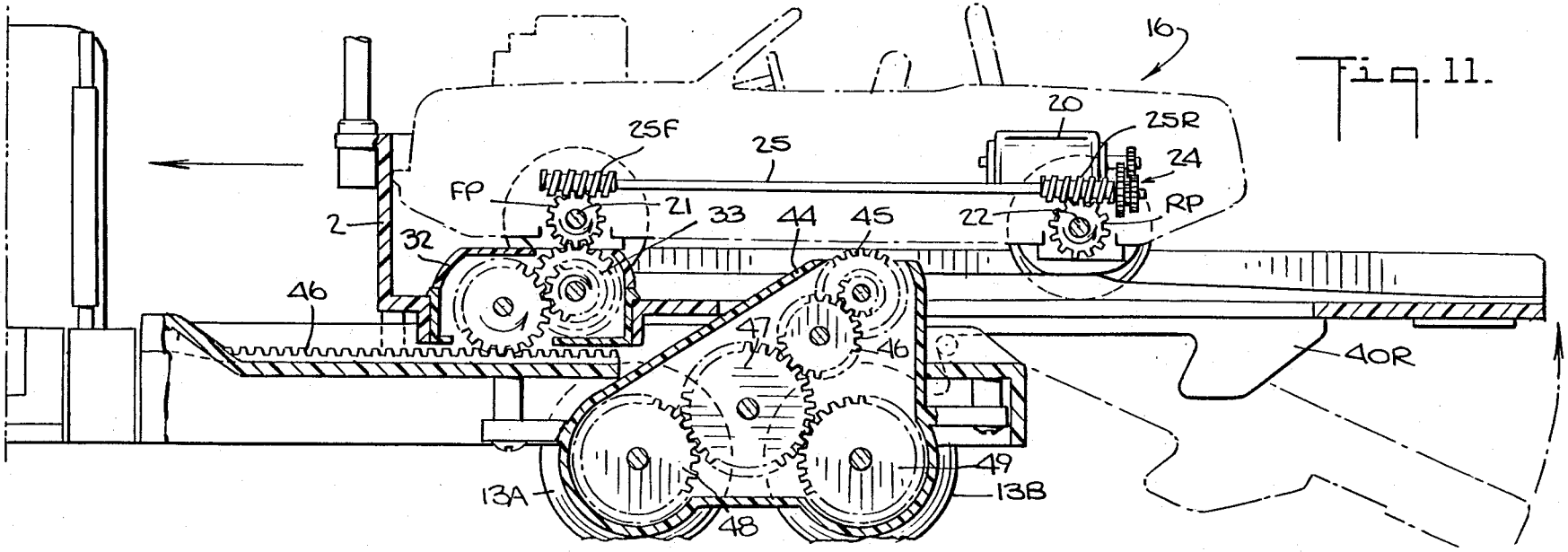
FIG. 11 shows the car on the ramp which is now returned to its extended horizontal position, the view being partly in section to show the relationship then existing between the front and rear pinion gears of the car with respective gears on the ramp and the truck so that only the ramp gear is then engaged to cause the ramp to advance along the truck bed from its extended to its retracted horizontal position.
Figure 12:
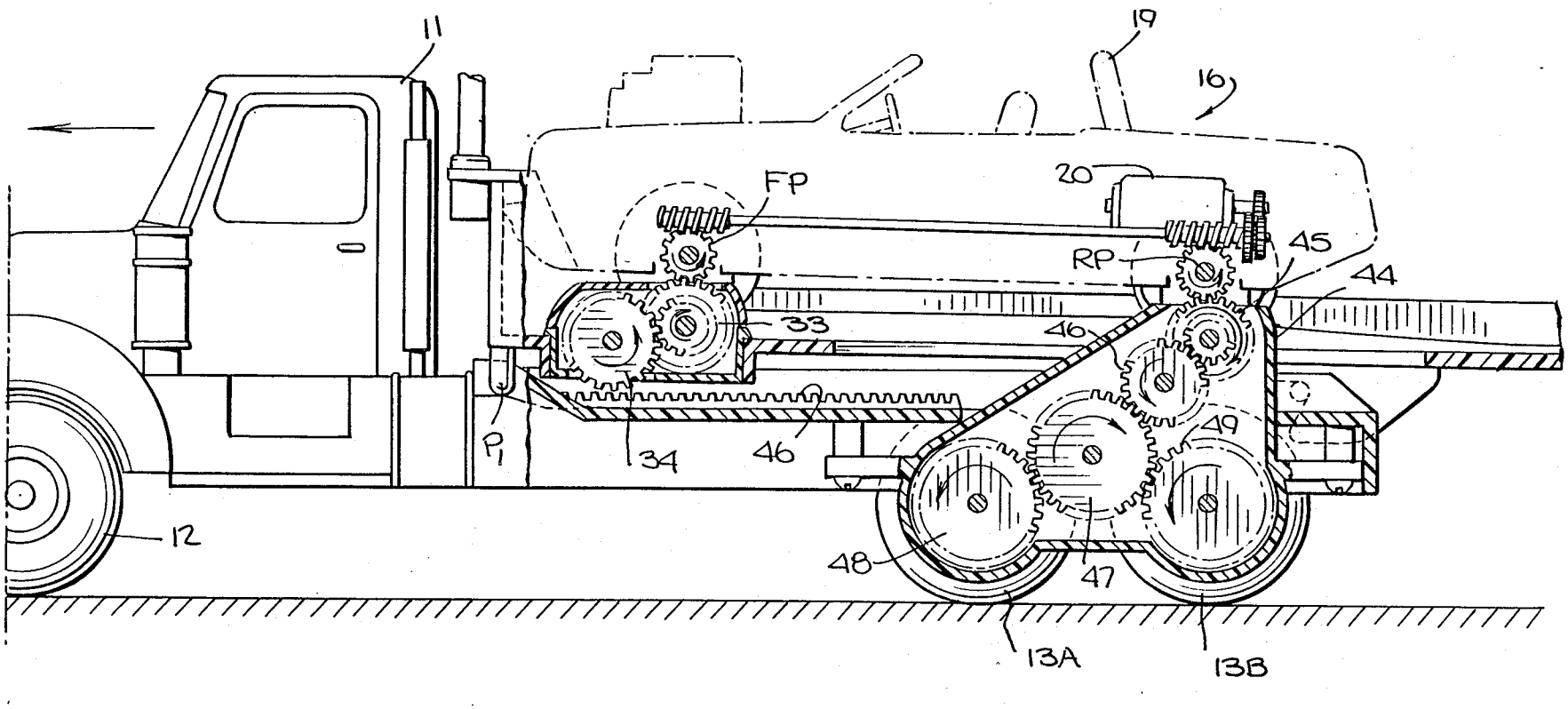
FIG. 12 shows the car on the ramp when the ramp is in its retracted horizontal position, at which position the rear pinion on the car which is switched to operate in the forward mode acts to engage the input gear of the truck to drive the rear wheels thereof.

As best seen in FIGS. 11 and 12, bed pinion 45 is operatively coupled to rear wheels 13A and 13B of the truck by an intermediate gear 46 which meshes with a coupling gear 47 that on one side engages shaft gear 48 on the axle of rear wheel set 18A, and on the other side engages shaft gear 49 on the axle of rear wheel set 13B. Hence when bed gear 45 is caused to rotate in the clockwise direction and is in engagement with the rear pinion RP of the motorized car 16, as shown in FIG. 2, both sets of rear wheels are caused to turn concurrently in the clockwise direction.

Figure 2:
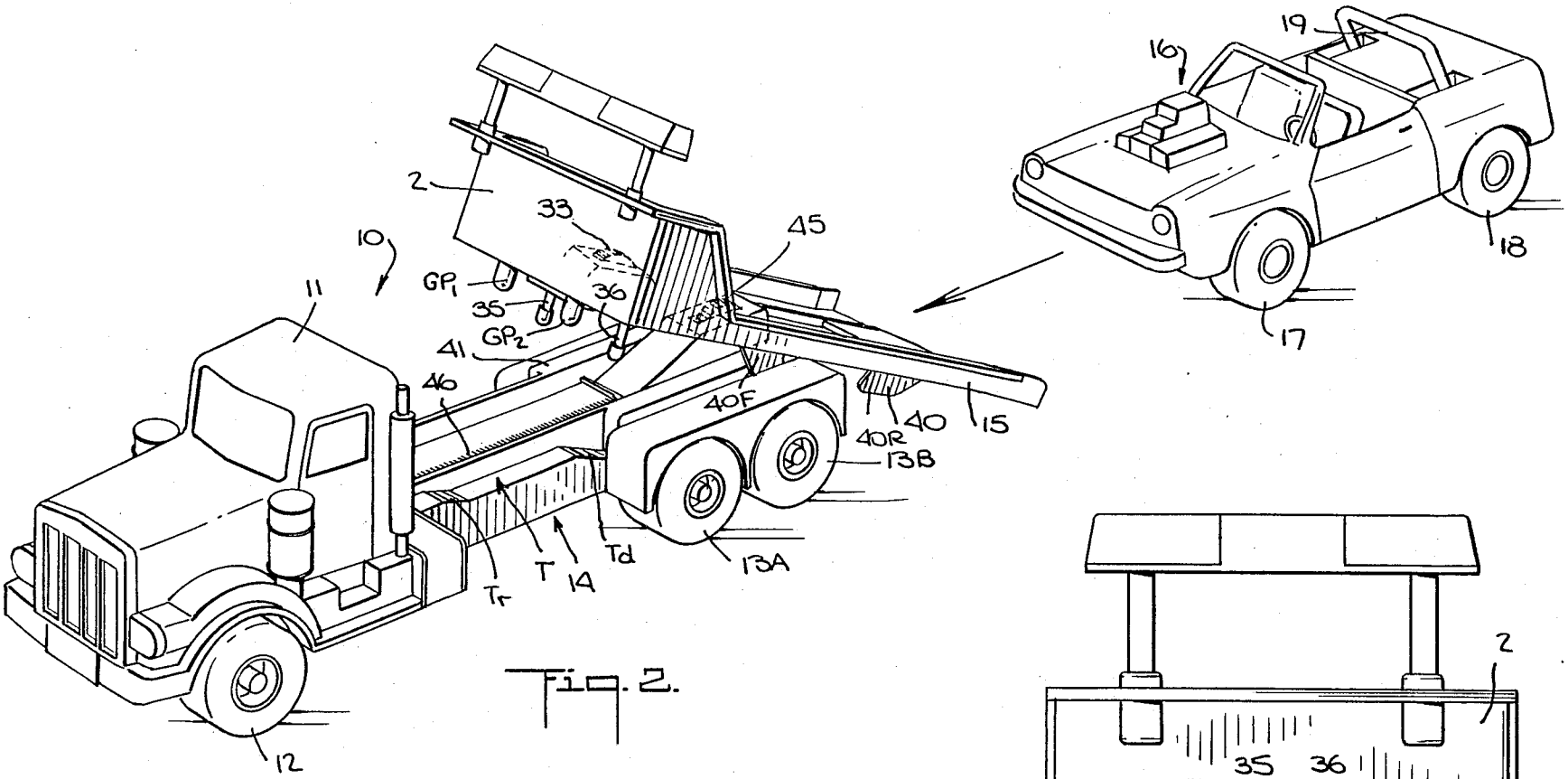
FIG. 2 illustrates the assembly with the car removed from the truck, the ramp of the truck being in its downwardly inclined position to receive the oncoming car.
Figure 5:
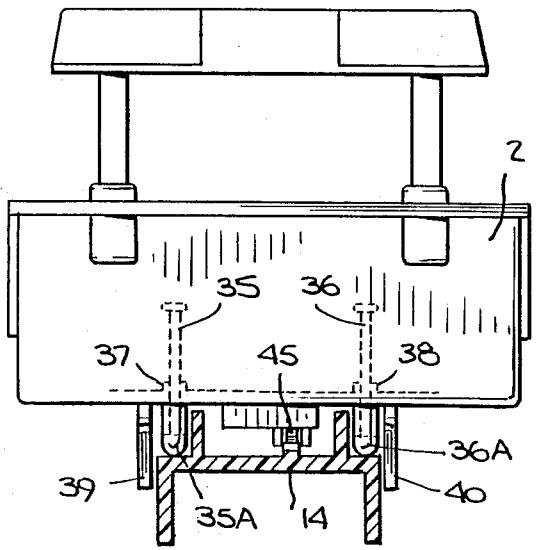
FIG. 5 is a front end view of the ramp when it is horizontal and seated on the bed of the truck.
Figure 3:
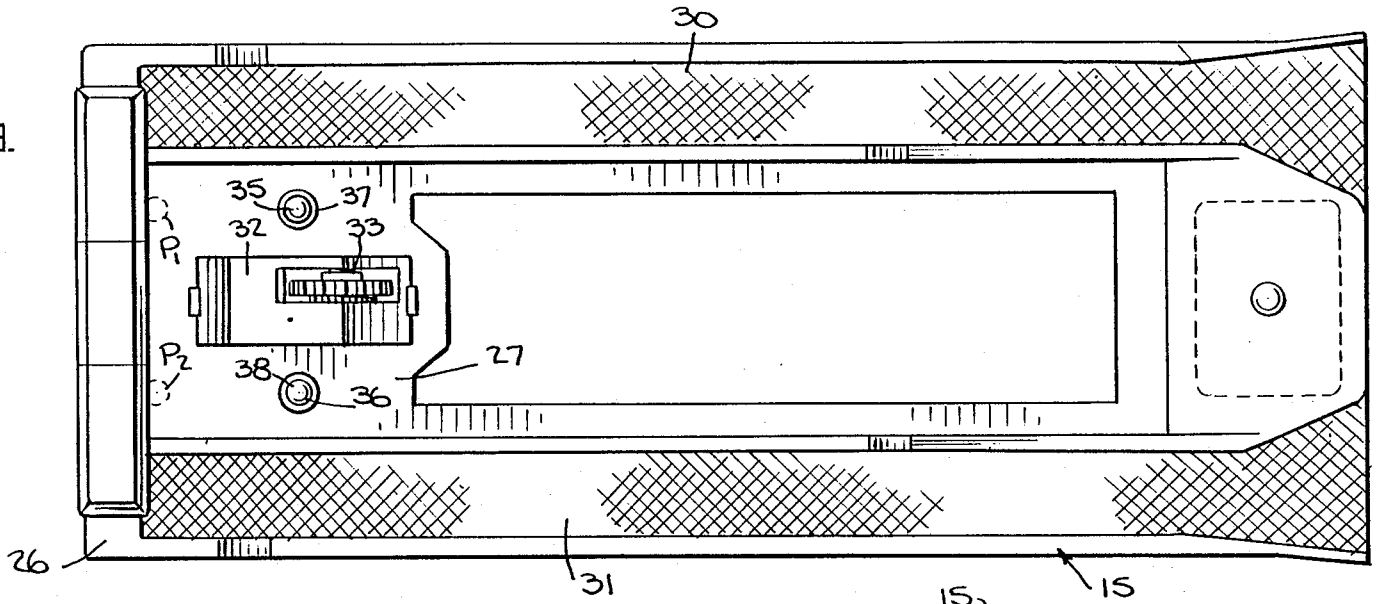
FIG. 3 is a top plan view of the ramp.
Figure 4:
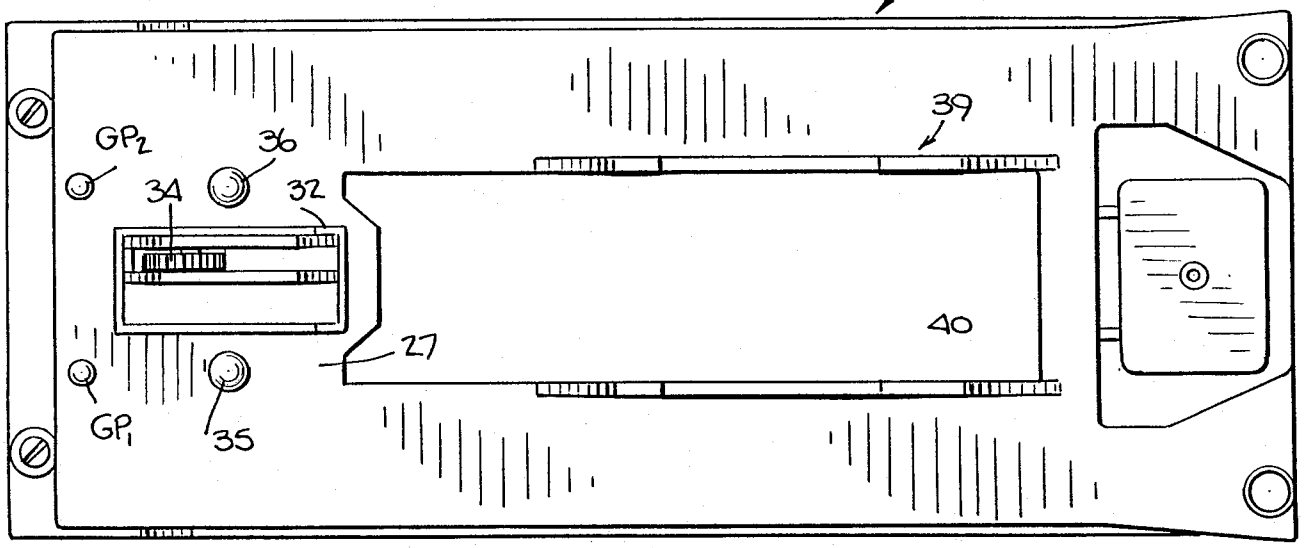
FIG. 4 is a bottom plan view of the ramp.

As shown in FIGS. 2, 3 and 4, projecting below the front end of ramp 15 are guide posts $GP_1$ and $GP_2$ which are positioned in advance of pins 35 and 36, respectively, and are in longitudinal alignment therewith. When the ramp slides on the bed of the truck, the posts and pins ride along correspondingly positioned contoured upper tracks T on bed 14. Each track, as best seen in FIGS. 8 and 9, at its rear end has a flat low level at its rear end that leads up a first incline $T_1$ to an intermediate flat level that, in turn, leads up a second incline $T_2$ to a high level at the front end of the track.

Hence when, as shown in FIG. 8, ramp 15 is in its extended horizontal position and car 16 is on the ramp with its front end near abutment 26, then shoe 35A of the tip of hold pin 35 is on track T at its low level in advance of incline $T_1$, and the head of the pin is then below the holding socket $S_1$ on the underside of car 16. Guide post $GP_1$ is then at the intermediate level of track T. In this position, the ramp pinion 34 engages rack 46 on the bed of the truck, and since the drive pinion FP on the car is rotating, this causes ramp 15 to advance from its extended position toward its retracted position.

At the retracted horizontal position of the ramp, as shown in FIG. 9, hold pin 35 having traveled up incline $T_1$ from the low level on track T to the intermediate level, is now sufficiently raised to enter holding socket $S_1$ in the car, thereby locking the car in place on the ramp.

Guide post $GPO_1$, having traveled from the intermediate level on the track up the incline $T_2$ to the high level, now acts at this level to slightly raise the front end of ramp 15, and in doing so brings about disengagement of ramp pinion 34 from rack 46; hence no further advance of the ramp along the bed can take place.

However, in the retracted horizontal position of the ramp, rear drive pinion RP is now in engagement with bed gear 45 of the truck, and since this drive pinion is turning, it acts to transfer drive power from the car to the truck to cause the truck to move in the forward direction.

The relationship of front drive pinion FP and rear drive pinion RP to the rack and bed gears in the retracted horizontal position of the ramp is best shown in FIG. 12 where it will be seen that in this position, rack 46 on the bed is decoupled from front drive pinion FP since ramp pinion 34 is disengaged from the rack; hence no movement of the ramp on the bed occurs, whereas rear drive pinion RP is then operatively coupled to the rear wheels 13A and 13B of the truck by way of bed gear 45 so that the motor on the car now acts to propel the truck forward.

Figure 13:
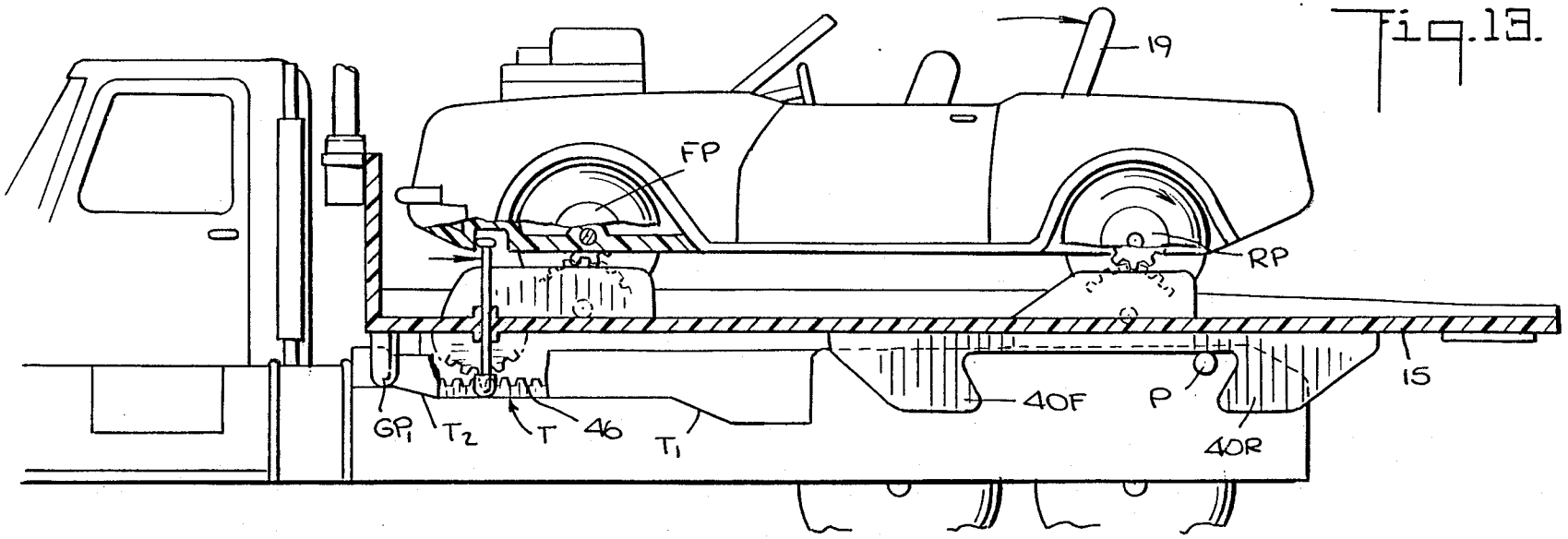
FIG. 13 shows the car on the ramp in its retracted horizontal position at which the car is locked in place, the car being now switched to operate in the reverse mode.
Figure 14:
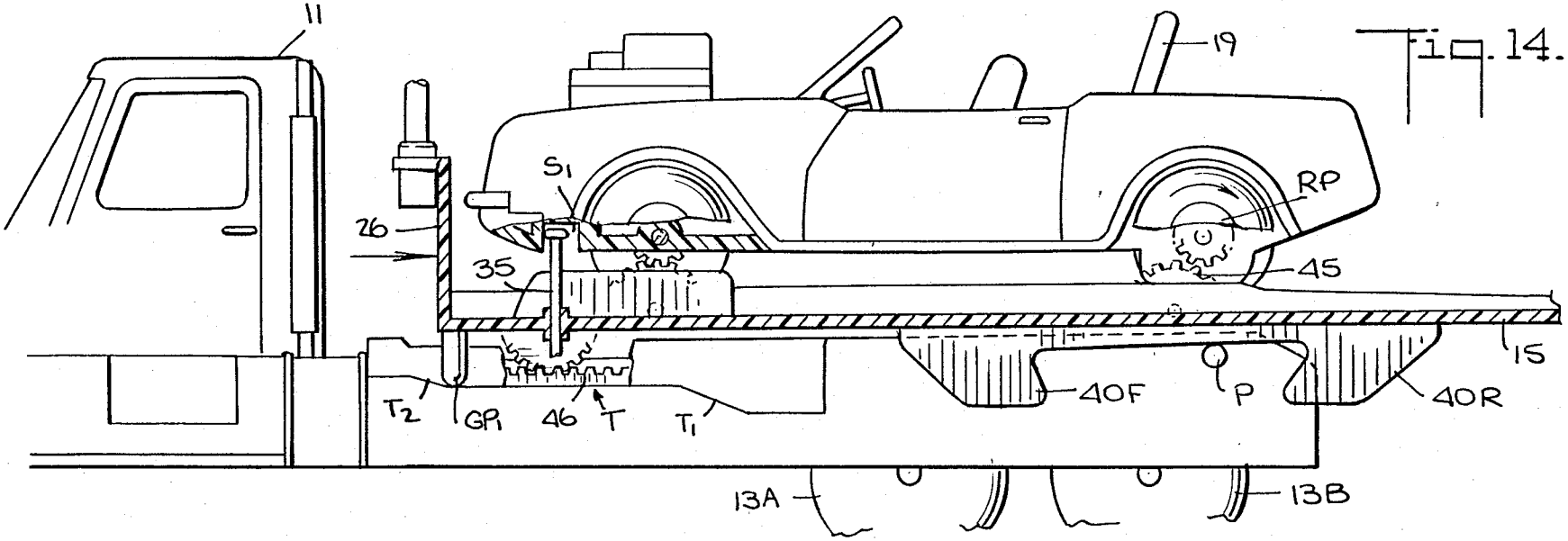
FIG. 14, which is similar to FIG. 13, shows the car on the ramp in its retracted horizontal position, the car now operating in the reverse mode to cause the ramp to shift toward its extended horizontal position.

In FIG. 13, the ramp is still in its retracted position with front drive pinion FP decoupled from rack 46 for ramp pinion 34 is disengaged from the rack, but now roll bar 19 has been tilted to the reverse mode; hence rear drive pinion RP, as shown in FIG. 14, then acts against bed gear 45 to shift guide post $GP_1$ from the high level of track T down incline $T_2$ to to the intermediate level, thereby causing ramp pinion 34 to again engage bed rack 46. As a result of this action, ramp 15 proceeds to advance toward its extended horizontal position. In the course of this advance, hold pin 35 rides down incline $T_1$ of track T to the low level of this track, and hold pin 35 drops out of socket $S_1$, thereby freeing the car which proceeds to run in reverse on the ramp. When the ramp reaches its extended horizontal position, the car position is such as to cause the ramp, whose front blade tooth 40F now engages pivot pin P, to swing down, thereby inclining the ramp to the ground and permitting the car to run in reverse down the ramp and away from the truck.

Operation of The Assembly

One can play with the car and truck separately. Thus the truck, which is not motorized and is free wheeling, can be loaded by putting blocks on the ramp, and the load can be dumped by bringing the ramp to its extended horizontal position and then swinging it down. And the car can be played with by manipulating the roll bar to cause it to run forward or backward under motor power, or to free-wheel with the roll bar in neutral. The invention is not limited to a car having a roll bar, for other forms of mode selectors may be used.

If the player now wishes to play with the car and truck as a cooperating assembly, then he starts with the set-up shown in FIG. 3 in which ramp 15 is inclined and car 16 is behind the ramp. By pushing roll bar 19 forward, the car which is now in the forward mode, proceeds, as shown in FIG. 10, to climb up the ramp and to cause the ramp to swing down to its extended horizontal position, as shown in FIG. 11. In practice, a ballast may be placed in the car at the front end thereof to enhance the effect of the car on the ramp to bring about a swing.

In this position, only front drive pinion FP is effective, for it engages ramp gear 33 which is operatively coupled to ramp pinion 34 which then engages rack 46 to cause the ramp to advance toward its retracted position adjacent cab 11 of the truck.

In this retracted horizontal position, as shown in FIG. 12, ramp pinion 34 is now disengaged from rack 46 and the ramp no longer advances, but now rear drive pinion RP on the car is operatively coupled to the two sets of rear wheels 13A and 13B of the truck, as a result of which motor 20 of the car acts to drive the truck in the forward direction.

If now the player wishes to bring the truck to a halt, he simply pushes roll bar 19 on the car to neutral. And if he wishes to again drive the truck, he moves roll bar 19 to its forward position, which is the position shown in FIG. 12.

If now the player wishes to have the car run off the truck so that he can play with it separately, he then, as shown in FIGS. 13 and 14, pushes roll bar 19 back to the reverse mode, thereby causing the ramp to shift from its retracted to its extended horizontal position, at which position the ramp under the weight of the car is caused to swing downwardly, the car then running down the inclined ramp and away from the truck.

It is to be noted that gravity plays an important role in the operation of the assembly; for when the car runs up the inclined ramp, it reaches a point thereon where its center of gravity is in advance of the pivot axis of the ramp, thereby causing the inclined ramp to swing down on the bed of the truck. And it is gravity which causes the hold pins to drop out when necessary.

Thus the assembly of car and truck has many play possibilities that range well beyond the play capabilities of the car and truck separately.

In the arrangement disclosed herein, when the car is on the truck with the ramp in its retracted horizontal position, and the car is switched to the reverse mode, this action causes the ramp to shift from its retracted to its extended horizontal position, the ramp then under the weight of the car being caused to swing downwardly to permit the car to run down the ramp. However, by providing retractable means to lock the ramp at its retracted horizontal position to the bed of the truck, such as a removable pin, then when the car on the truck is switched to the reverse mode, the motorized car will then act to drive the truck in reverse, thereby providing still another play possibility.

In practice, the retractable means to lock the ramp in its retracted horizontal position to the truck bed may take the form of a latching hook extending from the rear of the truck cab to engage a ridge on the underside of the front ledge of the ramp. The latching hook is depressible to release the ramp, this release being effected by a spring-biased button on the top of the cab which is operatively coupled to the latching hook.

The car by itself is of play interest, for it can be operated with four wheel drive in forward and reverse, or it can be switched to neutral, in which mode it is free wheeling. Alternatively, it can also be made to operate selectively either with two wheel drive or with four wheel drive in an arrangement in which the horizontal drive shaft 25 (see FIG. 10) is shiftable from a position in which its front and rear worm gear sections 25F and 25R engage the front and rear wheel drive pinions FP and RP, as illustrated, to a position (not shown) in which the front worm gear section is out of engagement with the front drive pinion and the rear worm gear section engages an auxiliary pinion on the rear wheel axle which provides a gear ratio producing a higher speed than with four wheel drive.

While there has been shown and described a preferred embodiment of a piggyback toy car and truck assembly in accordance with the invention, it will be appreciated that many changes and modifications may be made therein without, however, departing from the essential spirit thereof.

The car in either the forward or reverse mode cannot be free wheeled, but when the motor is energized, it will go in the forward direction or in reverse. Without batteries or with dead batteries, the car is effectively braked and a switching action from neutral in which the car is free wheeling to forward or reverse instantly brakes the car.

We claim:

1. A piggy back toy car and truck assembly comprising:

A a four-wheel car having a DC motor powered through a mode selector to a battery source and operatively coupled to front and rear drive pinions mounted on front and rear wheel axles whereby when the selector is in a forward mode, all four wheels are driven to propel the car in the forward direction, and when the selector is in the reverse mode, all four wheels are driven to propel the car in the reverse direction;

B a motorless truck provided with a flat bed having a front section on which there is a rack that extends to a rear section on which is rotatably supported a bed gear, said truck having rear wheels whose axle is below the rear section of the bed and is operatively coupled to said bed gear whereby when said bed gear is engaged by the rear drive pinion of the car operating in the forward mode, the rear wheels are then caused to rotate to propel the truck in the forward direction;

C a ramp having a pair of parallel tracks to accommodate the wheels of the car, said ramp having adjacent its front end an upper ramp gear operatively coupled to a lower ramp pinion, said ramp being slidable from a retracted horizontal position to an extended horizontal position at which about half of the ramp overhangs the rear of the bed and is then pivoted to the bed whereby the ramp can then swing down to an inclined position, making it possible for the car in the forward mode to climb the ramp until it reaches the front end thereof and causes the ramp to return to its extended horizontal position at which point the front drive pinion of the car meshes with the ramp gear to cause the associated ramp pinion which then engages the rack to advance the ramp to its retracted horizontal position, at which retracted position the rear drive pinion engages the bed gear to propel the truck.

2. A toy assembly as set forth in claim 1, wherein said motor is operatively coupled to a horizontal drive shaft that extends between the front and rear drive pinions, the shaft having a front worm gear section that engages the front drive pinion and a rear worm gear section that engages the rear drive pinion, the shaft being caused by the motor to turn in one direction in the forward mode and in the reverse direction in the reverse mode.

3. A toy assembly as set forth in claim 2, wherein said shaft is disengaged from the front and rear drive pinions in the neutral mode.

4. A toy assembly as set forth in claim 1, wherein said mode selector is actuated by a roll bar on the car which is shiftable from an upright neutral mode position to either an angled forward mode position or to a reversely-angled reverse mode position.

5. An assembly as set forth in claim 1, wherein the teeth of front and rear drive pinions project below the underside of the car.

6. An assembly as set forth in claim 1, wherein said truck is provided at its front with a driver's cab behind which is said bed, the front end of the ramp being adjacent the rear of the cab in the retracted horizontal position.

7. An assembly as set forth in claim 1, wherein said ramp is provided with a pair of headed hold pins at spaced positions along a transverse axis adjacent the front end of the ramp, the pins being supported for vertical reciprocation, the tips of the pins riding on contoured tracks along either side of the bed whereby the pins are lifted to an intermediate track level when the ramp reaches its retracted position, at which level the heads of the lifted pins are received in holding sockets in the underside of the car to prevent displacement of the car.

8. A toy assembly as set forth in claim 7, wherein said ramp is provided with a pair of posts which project below the ramp and are positioned in front of the pins in longitudinal alignment therewith, the posts riding on said tracks and occupying an elevated level thereon when the ramp reaches its retracted horizontal position, the posts then slightly raising the front end of the ramp to effect disengagement between the ramp pinion and the bed rack.

9. A toy assembly as set forth in claim 1, wherein said ramp is provided at its underside with a pair of longitudinally extending blades which ride within parallel channels in the bed along the rear section thereof, said blades being contoured to define a front tooth spaced from a rear tooth, the front tooth in the extended horizontal position of the ramp engaging a pivot pin on the bed which limits further horizontal movement but permits the ramp to swing about the pivot pin, the pivot pin being engaged by the rear tooth in the retracted horizontal position of the ramp to limit further movement thereof.

10. A toy car as set forth in claim 1, wherein said car when positioned on the ramp in the retracted horizontal position thereof and selected to operate in the reverse mode acts when the ramp is latched to the bed to drive the truck in reverse.

11. A piggy back toy car and truck assembly comprising:

A a motorized car provided with front and rear wheels and axles therefor, the car being selectively operable in either the forward or reverse direction mode in which both the front and rear wheels are driven concurrently to propel the car in a selected direction;

B a motorless truck provided with front and rear wheels and axles therefor, and a flat bed on which is slidable a ramp having a pair of tracks to accommodate the car wheels; said ramp being slidable from a retracted horizontal position on the bed to an extended horizontal position in which the rear section of the ramp overhangs the rear of the bed and is pivoted therefrom so that it can be inclined relative to ground to permit the car in the forward mode to climb up the inclined ramp until it reaches the front end thereof and causes the ramp to return to its extended horizontal position;

C means operable when the ramp is returned to its extended position to derive power from the front wheel axle of the car on the ramp to cause the ramp to advance toward its retracted position; and D means operable when the ramp reaches its retracted position to derive power from the front wheel axle of the car to rotate the rear wheel axle of the truck, whereby the motorized car on the ramp then serves to propel the truck in the forward direction.

* * * * *